United States Patent [19]

Snyder

[11] Patent Number: 4,748,873

[45] Date of Patent: Jun. 7, 1988

[54] POWER WRENCH

[75] Inventor: Robert F. Snyder, Hamden, Conn.

[73] Assignee: Raymond Engineering Inc., Middletown, Conn.

[21] Appl. No.: 867,464

[22] Filed: May 23, 1986

[51] Int. Cl.[4] ..... B25B 13/46

[52] U.S. Cl. ..... 81/57.39; 81/57.44

[58] Field of Search ..... 81/57.39, 57.36, 57.40, 81/54, 57.44, 58.2

[56] References Cited

U.S. PATENT DOCUMENTS

| | | | |
|---|---|---|---|
| 1,812,812 | 6/1931 | Weaver . | |
| 1,871,857 | 8/1932 | Martois . | |
| 2,719,446 | 10/1955 | Ford . | |
| 3,448,641 | 6/1969 | Morrow | 81/58.2 |
| 3,745,858 | 7/1973 | Biach . | |
| 3,786,698 | 1/1974 | Diehl et al. . | |
| 3,791,242 | 2/1974 | Bartusch . | |
| 3,915,036 | 10/1975 | Vanlandingham et al. . | |
| 3,955,447 | 5/1976 | Parker . | |
| 4,027,560 | 6/1977 | Parker . | |
| 4,132,136 | 1/1979 | Wilmeth | 81/57.39 |
| 4,308,767 | 1/1982 | Wilmeth . | |
| 4,309,923 | 1/1982 | Wilmeth . | |
| 4,368,655 | 1/1983 | Junkers . | |
| 4,429,597 | 2/1984 | Grabovac et al. . | |
| 4,513,645 | 4/1985 | Grabovac et al. | 81/57.39 |

FOREIGN PATENT DOCUMENTS

| | | |
|---|---|---|
| 2749857 | 5/1979 | Fed. Rep. of Germany . |
| 2014495 | 8/1979 | United Kingdom . |

OTHER PUBLICATIONS

Maschinerrfabrik, P. H. Wagner, "Hydro--Plarad-R+K".

*Primary Examiner*—Frederick R. Schmidt
*Assistant Examiner*—Maurina Rachuba
*Attorney, Agent, or Firm*—Fishman, Dionne & Cantor

[57] ABSTRACT

A low profile power wrench is provided which is useful both for general application and for easy accesses to bolts and nuts in cramped or hard to reach places. The drive of the wrench and the reaction system are in tension, thereby resulting in important advantages for the wrench. The wrench includes a power cylinder having a piston rod extending therethrough. An anchor or reaction assembly comprising an anchoring ring and attached anchor rod is adjustably (i.e., threadably) attached to the piston rod to permit connection of the anchoring ring to a nut spaced from the nut to be turned. A wrench assembly comprising a preferably arcuate lever arm with a ratchet assembly is pivotably connected to the power cylinder. Operating fluid (hydraulic or pneumatic) is delivered sequentially to the power cylinder through first and second inlet/outlet openings. The piston rod carries a piston which separates the cylinder into a pair of chambers such that during a power stroke, the fluid will exert a load on one side of the piston or the other to cause the power cylinder (not the piston rod) to move in a linear direction. The moving cylinder will, in turn, urge the wrench assembly lever arm in a arching direction whereby the ratchet assembly turns a nut or bolt. During a return stroke, the fluid will exert pressure on the opposite side of the piston to return the wrench assembly to its original position. Adjustment means are provided which limit the angle between the lever of the ratchet assembly and the piston rod in order to maintain that angle constant at the beginning of each forward (power) stroke.

29 Claims, 3 Drawing Sheets

POWER WRENCH

BACKGROUND OF THE INVENTION

This invention relates generally to a torquing device. More particularly, this invention relates to an improved torquing device commonly called a power torque wrench which is pneumatically or hydraulically powered.

Powered wrenches for turning threaded connection members such as nuts and bolts are well known in the art. Such powered wrenches typically employ a ratchet mechanism which acts on a socket member which is suitably sized to turn a selected nut or bolt. It will be appreciated that power wrenches have a generally complex structure and are relatively large and bulky. As a consequence, it is difficult to utilize prior art powered wrenches in cramped or hard to reach places.

Many prior art power wrenches include a reaction unit or anchor adapter which attaches to a nut or bolt spaced from the actual nut or bolt which is being turned. Examples of such prior art power wrenches include U.S. Pat. Nos. 4,027,560; 4,132,136; 4,308,767; and 4,429,597. These power wrenches are adapted for driving a plurality of adjacently spaced members. The wrenches typically include a power cylinder and piston arrangement with a reaction or anchor assembly and a wrench assembly connected to the cylinder and/or piston.

As already mentioned, many of the prior art power wrenches are bulky and cumbersome and are therefore unable to access nuts or bolts in hard to reach places. Another disadvantage of these wrenches is that the reaction system usually involves loading in compression. It will be appreciated that constant compression on the reaction assembly may lead to problems relating to excessive bending stress and/or column strength. Another disadvantage with prior art power wrenches of the type discussed hereinabove is that such units are required to match a different socket member to each size of nut or bolt to be turned. Consequently, the power wrench operator must purchase and stock a collection of relatively large, heavy and expensive socket heads (one for each size nut). This leads to increased costs as well as the cumbersome necessity of supplying each field operator with a plurality of heavy sockets. Still another problem with prior art wrenches is the often times uneven driving force and loading exerted by the driving pawl on a nut or bolt during successive power strokes. Another problem exists with prior art wrenches in which the driver and driven parts are offset. Such wrenches, if they do not have a main housing, must have two reaction points, one for force and one for torque. Thus, such wrenches are either large, bulky and heavy (because of the main housing); or they must have two reaction points.

SUMMARY OF THE INVENTION

The above discussed and other problems of the prior art are overcome or alleviated by the power wrench of the present invention. In accordance with the present invention, a low profile power wrench is provided which easily accesses bolts and nuts in cramped or hard to reach places. The present invention includes a power cylinder having a piston rod extending therethrough. An anchor or reaction assembly comprising an anchoring ring and attached anchor rod is adjustably (i.e., threadably) attached to the cylinder piston rod to permit connection of the anchoring ring to a nut spaced from the nut to be turned, the anchoring nut being the single reaction point in the system. A wrench assembly comprising a preferably arcuate lever arm with a ratchet assembly is pivotably connected to the power cylinder. Operating fluid (hydraulic or pneumatic) is delivered sequentially to the power cylinder through first and second inlet/outlet openings. The piston rod carries a piston which separates the cylinder into a pair of chambers such that during a power stroke, the fluid will exert a load on one side of the piston or the other to cause the power cylinder (not the piston rod) to move in a linear direction. The moving cylinder will, in turn, urge the wrench assembly lever arm in a arcing direction whereby the ratchet assembly turns a nut or bolt. During a return stroke, the fluid will exert pressure on the opposite side of the piston to return the wrench assembly to its original position.

An important feature of the present invention is adjustment means which limit the angle between the lever of the ratchet assembly and the piston rod in order to maintain that angle constant at the beginning of each forward (power) stroke. The purpose of maintaining a constant angle between the lever arm and piston rod is to insure that the geometry of the stroke and consequently the accuracy of the wrench will be the same, no matter what bolt center distance the wrench is adjusted for by use of the threaded reaction ring assembly.

Another advantage of the present invention is the low profiled configuration which enables use thereof in low clearance, heard to reach areas.

Yet another advantage of the present invention is the rapid set-up of the wrench for various bolt/nut center distances and bolt/nut sizes. Also, the wrench is one integral unit unlike many prior art low profile tools.

The present invention does not require a plurality of cumbersome socket members, but instead utilizes more desirable star inserts which are easier to handle and transport; as well as being less expensive than prior art socket members.

Still another feature of the present invention is that the reaction rod (which forms a part of the anchor assembly) is always in tension rather than compression. This feature leads to improvements in weight reduction and being able to reach a long distance for large bolt spacing. The fact that the reaction rod is in tension results in an offset (i.e., between driver and driven members) wrench in which the main body is eliminated and which operates with only one reaction point. Also, the tension feature makes it possible to use long extenders in the reaction system to reach a remote reaction point (when no close reaction point is available). Systems in compression cannot use long extenders. The fact that only one reaction point is required means that the wrench can be used to tighten a flange or other joint that has just two nuts or bolts, without the need for an external reaction point. Other prior art wrenches require at least three nuts or an external reaction surface.

The above discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

DESCRIPTION OF THE PREFERRED EMBODIMENT

Figure 1:
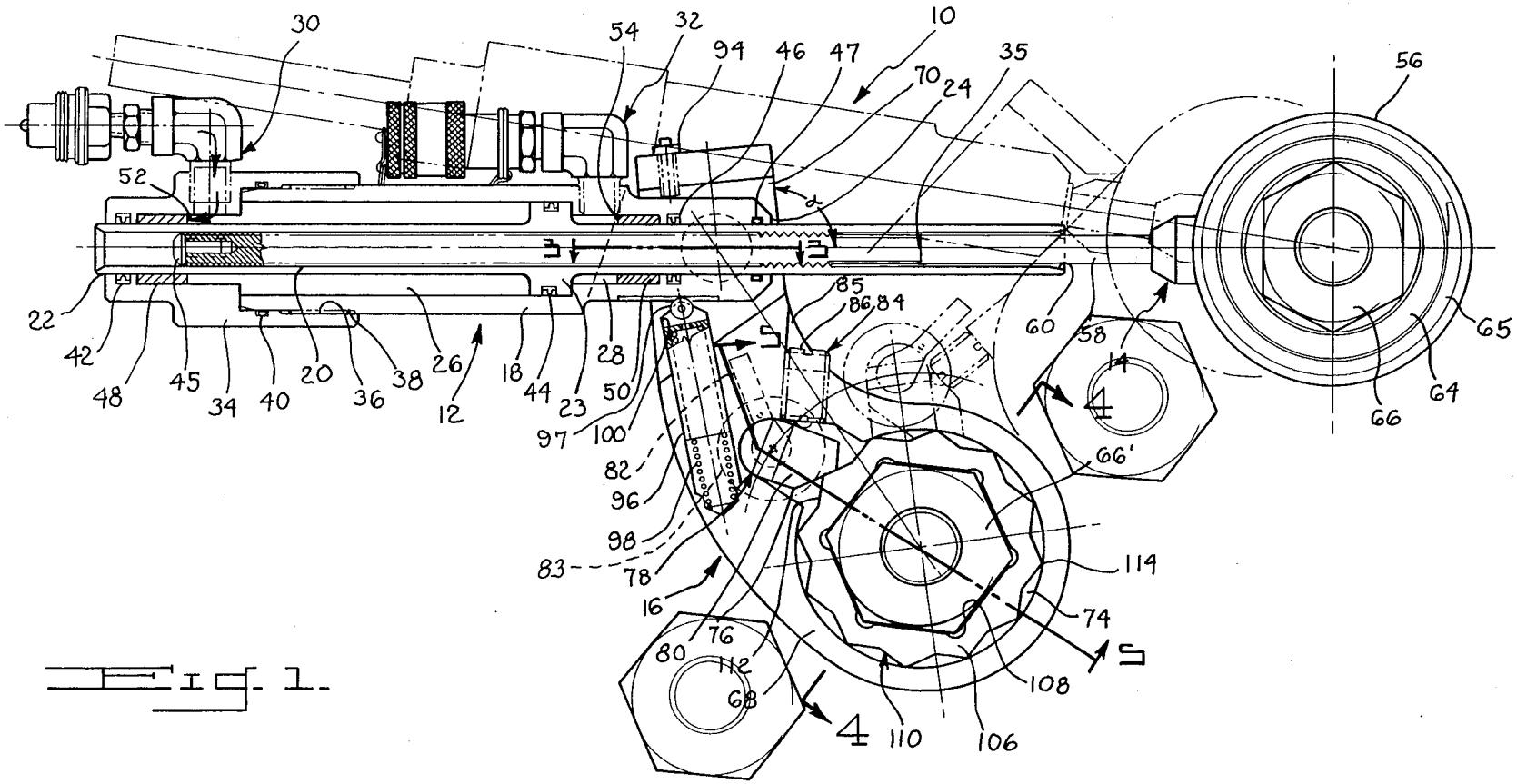
FIG. 1 is a side elevation view, partly in cross-section, of a power wrench in accordance with the present invention.

Referring first to FIG. 1, a power wrench especially adapted for driving one of a plurality of adjacently spaced nut or bolt members is shown generally at 10. Power wrench 10 comprises a power cylinder and piston arrangement 12, an anchor or reaction assembly 14 and a wrench or ratchet assembly shown generally at 16. The wrench is shown with the ratchet assembly 16 mounted on one nut of a ring of nuts (e.g., on a flanged joint), and the reaction assembly 14 mounted on a nut spaced two nuts away.

Power cylinder and piston assembly 12 includes a hydraulic or pneumatic cylinder 18 having a rigid piston rod 20 slidably mounted therein and adapted to extend outwardly therefrom at first and second cylinder openings 22 and 24. Piston rod 20 includes a centrally positioned annular piston 23. It will be appreciated that when cylinder 18 travels in a linear path relative to piston rod 20, piston 23 of rod 20 will divide the interior of cylinder 18 into a pair of chambers 26 and 28 (which change in size and volume as that relative travel occurs). Cylinder 18 is provided with a pair of inlet/outlet fluid lines identified generally at 30 and 32. Cylinder 18 is also provided with an end cap 34 having interior threads 36. Cap 34 is preferably threadably attached to cylinder 18 via exterior threads 38. Cylinder 18 is rendered fluid tight by use of O-ring 40 in end cap 34, and "T"-seals 42, 44, and 46. A wiper element 47, such as an O-ring, is positioned at one end of cylinder 18 for wiping any fluid from piston rod 20 as cylinder 18 moves over rod 20.

During use, piston rod 20 remains stationary (i.e., "tied" to a reaction nut or bolt) while cylinder 18 travels back and forth in an arcing direction (as indicated by the position of the piston rod and cylinder shown in the dashed lines). The solid line position of the wrench is the return or retracted position; the dashed line position is the actuated or power stroke position. Assuming, for example, that the wrench is in the actuated position and it is desired to move it to the return position, pressurized fluid (preferably hydraulic fluid) will be delivered to line 30 (as indicated by the arrows). The fluid will enter chamber 26 and be urged against side wall 52 of bearing 48. The fluid will exert a load against bearing side wall 52 causing cylinder 18 to move in a linear direction (toward the left side of FIG. 1 to move the wrench from the solid to the dashed line position) thereby forcing any fluid in chamber 28 therefrom and into line 32. Conversely, upon a power stroke (to move the wrench from the solid to the dashed line position), pressurized fluid will enter chamber 28 from line 32 thereby placing a load against the side wall 54 of bearing 50. In turn, this load will urge cylinder 18 in a direction toward the right side of FIG. 1 wherein fluid present in chamber 26 will flow therefrom into line 30. Thus, in accordance with the present invention, piston rod 20 will remain stationary with cylinder 18 moving in a back and forth, arcing motion as fluid respectively enters and exits chambers 26 and 28. As mentioned, cylinder 18 is provided with a series of seals 40, 42, 44 and 46 which act to prevent the flow of fluid either from chambers 26 and 28 through openings 22 and 24 or between chambers 26 and 28 around piston 23. It will be appreciated that, in the foregoing description of the power cylinder and piston arrangement, piston rod 20 will always be in tension (rather than in compression). This is an important feature of the present invention.

Figure 3:
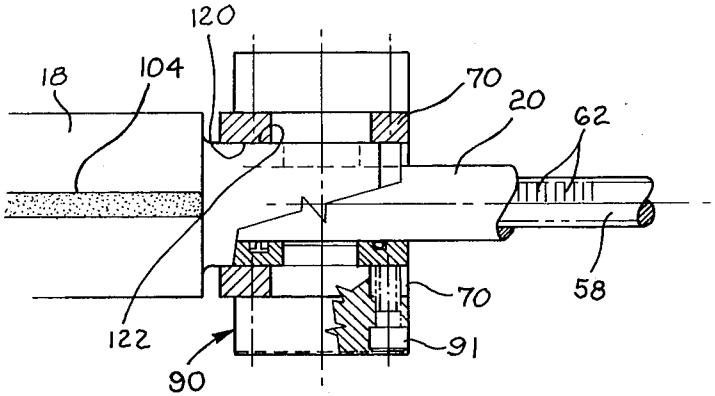
FIG. 3 is an enlarged side elevation view, partly in cross-section, of a portion of the anchoring assembly of the power wrench along line 5—5 of FIG. 1.

The anchoring or reaction assembly 14 includes an anchoring ring 56 which is joined (preferably welded) to a reaction rod 58. Reaction rod 58 preferably has a diameter which is slightly smaller than that of the inside diameter of piston rod 20, and essentially the entire length of rod 58 (except near ring 56) is threaded. Piston rod 20 has a longitudinal passageway 60 therethrough for receiving reaction rod 58. A small intermediate internal section of piston rod 20 is threaded, with raised threads (i.e., projecting into passageway 60) so that reaction rod 58 threadably engages the cooperating threading on the interior of longitudinal passage 60 in piston rod 20. As shown in FIG. 1, a stop screw 45 is releaseably threaded into the left end of rod 58. Stop screw 45 projects slightly beyond the O.D. of reaction rod 58 so that stop screw 45 will engage the internally projecting threads on piston rod 20. Thus, stop screw 45 functions to prevent reaction rod 58 from being entirely unscrewed out of piston rod 20 when making adjustments for bolt spacing. The use of a reaction rod 58 which is threadably connected to piston rod 20 is an important feature of the present invention. Referring to FIG. 3, suitable indicia 62 is provided on reaction rod 58 so that rod 58 may be lengthened or shortened depending upon the position of a nut which is to engaged by reaction ring 56. Thus, reaction rod 58 (and thereby reaction ring 56) is adjustable depending upon the relative locations between spaced nuts or bolts to be turned. The adjustability of anchoring assembly 14 is important as it permits the present invention to be used on spaced nuts of various configurations and dimensions with relative ease. Furthermore, reaction rod 58 may be extended, either by using a longer rod or by attaching additional rod segments, so that ring 56 can reach and engage a far remote reaction nut. Such long extension of a reaction system is not possible in prior art systems which are loaded in compression, but it is possible in the present invention which is loaded in tension.

Reaction ring 56 is provided with a series of adapter rings 64. The inner size of the various adapter rings 64 depends upon the size of the nut or bolt identified at 66 to which reaction ring 56 and adapter 64 are to be engaged. Thus, the wrench of this invention dispenses with the need for an array of expensive reaction elements of different sizes. One reaction ring and a family of inexpensive adapter rings 64 are all that are required. The adapter rings 64 are held in place by retaining springs 65 which seat in grooves in the reaction rings 64 above and below an adapter ring. A grease groove may be incorporated in reaction ring 56 since reaction ring 56 will rotate relative to a ring 64 under load.

Turning now to a discussion of FIGS. 1-4, the wrench or ratchet assembly is shown generally at 16 and is pivotably connected to cylinder 18. Ratchet assembly 16 comprises a preferably arcuate lever 68 having a pair of arms or yoke members defining a yoke 70 which surrounds cylinder 18. It will be appreciated that one of these yoke members 70 has been removed in FIGS. 1–3 for better clarity and understanding.

Lever 68 has a first circular opening 74 therein for receiving a socket member or preferably a "multipointed star" insert as will be discussed in more detail hereinafter.

Figure 5:
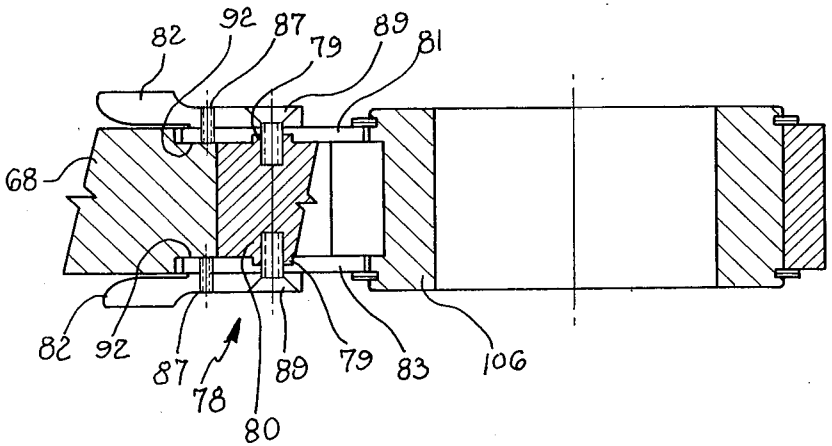
FIG. 5 is a view along line 5—5 of FIG. 1.

Referring to FIGS. 1 and 5, a second opening or pocket 76 in lever 68 communicates with first opening 74 and houses a ratchet device 78. Ratchet device 78 includes a driving pawl 80, a pair of upper and lower circular retainer plates 81, 83 and a ratchet release lever 82 (retainer plate 81 and lever 82 are removed in FIG. 1 for clarity). The plates 81, 83 are keyed to pawl 80 by a key connection 79. Ratchet release levers 82 are pinned to plates 81, 83 at pins 87. Suitable fasteners 89 are threaded through release lever 82, and retainer plates 81 and 83 into pawl 80 to threadably fasten lever 82 and plates 81 and 83 to pawl 80. The retainer plates 81 and 83 are located in countersunk circular recesses 92 in the upper and lower surfaces of lever 68, the diameter of the recesses 92 being slightly greater than the diameter of plates 81, 83. A lever 82 is associated with each plate 81,83.

Since lever 82, plates 81, 83 and pawl 80 are fastened together, the pawl 80 is retained in place in pocket 76. Since lever 82 is pinned to plate 81, counterclockwise rotation of lever 82 will rotate pawl 80 out of the way from its normal projection into opening 74 in contact with star member 106 to allow removal and insertion of different sized star driving members 106 or to free up member 106 when lever 68 and driving member 106 are being mounted on a nut or bolt to be driven.

The difference in diameters between circular plates 81, 83 is greater than the spacing between the rear arcuate surface of pawl 80 and the rear 76' of pocket 76. Thus, when a load is imposed on a nut to be driven, pawl 80 can move to ground against the rear 76' of the pocket, and hence ground against the main body of lever 68. The entire body of lever 68 is of hardened steel (32–36 Rockwell) to bear the load thus imposed on it.

A pawl return 84 is provided in a bore 85 in lever 68 to contact driving pawl 80. Pawl return 84 includes a plunger 86 which contacts and is urged against pawl 80 via a spring 93 which is held in place by a set screw 95. When release lever 82 is actuated, driving pawl 84 will pivot against plunger 86 to compress spring 93. When lever 82 is released, the force of spring 93 and plunger 86 will return pawl 82 into engagement with star member 106.

Figure 2:
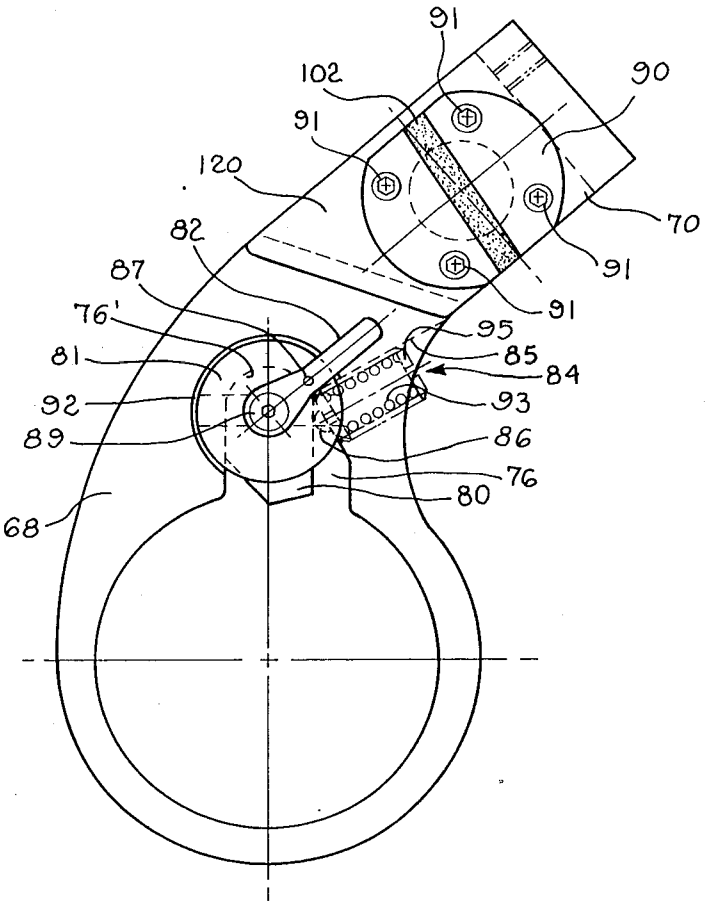
FIG. 2 is an enlarged side elevation view of the wrench assembly portion of the power wrench shown in FIG. 1.

Lever 68 is pivotably mounted on cylinder 18 via a pair of pivot caps 90, each of which is fastened to a yoke member 70 by four cap screws 91, as shown in FIGS. 2 and 3. It will be appreciated that lever 68 will pivot relative to cylinder 18 about pivot caps 90 in the plane of the paper of FIG. 1. During such pivoting, pivot cap 90 remains stationary relative to yokes 70 and lever 68 but pivots relative to cylinder 18. Thus, the pivot cap 90/cylinder 18 attachment defines a bearing.

As best seen in FIGS. 2 and 3, the yoke portion 70 of lever arm 68 has flat surfaces 120 which engage flat surfaces 122 on cylinder 18. Thus, while arm 68 is free to pivot relative to cylinder 18 in the plane of the paper, arm 68 can not rotate about the longitudinal axis of the cylinder and reaction rod (i.e., into or out of the plane of the paper). This provides an important feature of the present invention in that all parts of the wrench, i.e., piston and cylinder assembly 12, ratchet assembly 16 and reaction assembly 14 remain in the same plane relative to each other when the wrench is being mounted on a nut to be driven and a reaction nut. This is a significant improvement over prior art wrenches which have parts that flop around relative to each other and have to be restrained. Also, it will be noted that flat surfaces 124 and 126 on each yolk 70 limit the pivoting movement of arm 68 in the plane of the paper.

An important structural feature of ratchet assembly 16 is an adjustment means which limits the angle $\alpha$ between the lever arm 68 and the piston rod 20 in order to maintain that angle constant at the beginning of each forward (power) stroke. The purpose of maintaining a constant angle between the lever arm and cylinder piston rod is to insure that the geometry of the stroke and consequently the accuracy of the wrench will be the same, no matter what bolt center distance the wrench is adjusted for by changing the extension of reaction ring. Referring to FIG. 1, the adjustment means comprises an adjustable set screw 94 threadably mounted in yoke 70 and a roller guide assembly 96 with an end roller 97 in contact with cylinder 18. Roller guide assembly 96 has a compression spring 98, and both assembly 96 and spring 98 are housed in a bore 100 longitudinally disposed in lever 68. Spring actuated roller guide assembly 96 exerts a load on cylinder 18. Thus, during assembly, set screw 94 is adjusted to set the desired angle $\alpha$ between lever 68 and cylinder 18. Ordinarily, that angle $\alpha$ will not be readjusted during operation of the wrench, thus assuring accuracy of the tool regardless of bolt spacing. Preferably, alignment indicia 102 and 104 (such as paint stripes) are provided on lever 68 and cylinder 18, respectively to rapidly set the desired setting for set screw 94 both for initial assembly and for resetting the angle $\alpha$ if the setting is somehow changed during operation. During a return stroke, roller guide assembly 96 will urge cylinder 18 against set screw 94 thereby maintaining angle constant at the beginning of each forward (power) stroke.

Figure 4:
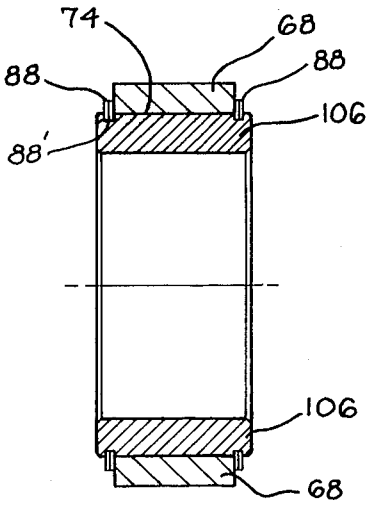
FIG. 4 is a cross-sectional elevation view along the line 4—4 of FIG. 1.

As mentioned, the ratchet assembly 16 of the present invention permits the novel use of star inserts rather than conventional and well known socket members. Such star inserts are easier to handle and transport relative to cumbersome socket members and are substantially less expensive. In FIG. 1, a star member is shown at 106 which is suitable for turning a six point nut or bolt. Star member 106 simply comprises a substantially flat metal annular disc having an interior opening 108 corresponding to the size of the nut or bolt to be turned and a outer peripheral edge 110 having a plurality of flat surfaces 112. Each adjacent pair of flat surfaces 110 form a point 114 with the direction of points 114 alternating between the interior and the exterior of the star member. Turning to FIG. 4, star inserts 106 are preferably retained in position by a pair of spring retaining rings 88 which sit in grooves 88'. For purposes of clarity, the rings 88 are not shown in FIG. 1. Retaining rings 88 also function to permit quick and easy removal and replacement of different internal size for driving different sized nuts.

The operation of the power wrench 10 will now be described, with arm 68 and star driver member 106 positioned on a nut 66' to be driven and reaction ring 56 and adapter ring 64 on a reaction nut 66. During a power stroke, cylinder 18 will travel to the right in FIG. 1 as discussed hereinabove whereupon the wrench will travel in an arcing direction to the position indicated in the dashed lines. Pawl 80 will be urged against a flat section 112 of star insert 106. In turn, star insert 106 will rotate and thereby rotate nut or bolt 66. The load imposed on pawl 80 will be transmitted to the rear 87 of pocket 76 and thence into lever arm 68. On the return stroke, pawl 80 will be rotated counterclockwise as it climbs over the raised point of a star to assume its position for the next power stroke. When pawl 80 is rotated counterclockwise, a load will be placed on pawl return 84 thereby compressing spring 93 and plunger 86. After pawl 80 climbs over the next trailing point, compressed spring 93 and plunger 86 will urge driving pawl 80 back to its original position so as to contact another flat surface of star insert 106 which will have taken the position originally held by flat 112. As already mentioned, also during the return stroke, the roller-guide assembly 96 will urge cylinder 18 against set screw 94 so as to maintain angle $\alpha$ constant at the beginning of each power stroke.

As mentioned hereinabove, the power wrench of the present invention is especially well suited for use in conjunction with those applications wherein the nut or bolt to be turned is in a hard to reach or cramped place. This is because the present invention has a low profile or low clearance configuration providing a compact unit. However, the wrench also has general utility as well.

As previously noted, the reaction system of the present invention, including reaction rod 58 and ring 56, are in tension when a load is imposed to turn a nut. This is a very important feature of the present invention. This makes it possible to dispense with a bulky and heavy general housing for the wrench (while still achieving a one point reaction system), and it makes it possible for the wrench to be light weight relative to its load capacity. Since the reaction system is in tension, only one reaction point (for force) is needed, even though driven and driving parts of the wrench are offset. No torque reaction point is needed as in other offset wrenches.

The tension reaction loading also makes it possible to ground the reaction ring to a far remote nut or other point by the use of a single very long reaction rod or by reaction rod extenders (fastened together). This is not possible for a system in compression.

The tension reaction load feature also makes it possible to use the wrench on a two nut joint; other offset systems require at least three nuts (or two nuts and an external reaction surface).

The interchangeabililty of drive star inserts and reaction ring inserts is an important technical and commercial feature. This makes the wrench very economical for use over a wide range of nut sizes.

Also, resetting the reaction arm for different bolt ring arrangements is extremely simple. At the most, two simple adjustments (one for length of the reaction arm, the second for reaction insert size) are required to go from one joint configuration to an entirely different joint configuration. In fact, in many cases only one adjustment (reaction arm length) may be required, since one reaction insert may be used on several size nuts.

Other important features of the present invention include simplicity of design and relatively few parts, the use of relatively inexpensive and easier to handle star inserts (relative to socket members); adjustment means for maintaining the angle between the cylinder and the lever at the start of each power stroke; and pivotable connection means between the movable cylinder and ratchet assembly.

It will also be understood that the wrench can be used to drive a nut in either direction (i.e., clockwise or counterclockwise), by flipping the wrench. Also, while reference has generally been made to driving a nut, it will be understood that the wrench is usable on bolt heads or other fastener elements.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A fluid powered in line wrench for torquing a member comprising:

cylinder means having at least a pair of fluid input/output lines and including an internal cavity;

piston means slidably received in said internal cavity of said cylinder means, said piston means having a piston rod and a piston on said piston rod, said piston contacting said internal cavity whereby said internal cavity is divided into a pair of chambers with at least one of said fluid input/output lines communicating with each chamber wherein said cylinder mean is adapted for linear movement between a power stroke and a return stroke as fluid enters and exits each chamber from said input/output lines, said piston rod extending outwardly of said cylinder means at one end of said cylinder;

reaction assembly means attached to a portion of said extending piston rod, said reaction assembly means including means for removable engagement with a reaction element, and said reaction assembly means being in tension during a power stroke of said wrench;

lever arm means pivotably attached to said cylinder means;

ratchet assembly means in said lever arm means, said ratchet assembly means including engagement means having an opening therethrough for removable engagement with a member to be turned, and ratchet means communicating with said opening for actuating the member to be turned; and means for establishing a preselected angle between said lever arm means and said cylinder means at the beginning of each power stroke.

2. The wrench of claim 1 wherein said cylinder means includes:

means for sealing said pair of chambers.

3. The wrench of claim 1 including:

a pair of oppositely disposed bearing side walls in each of said chambers of said internal cavity.

4. The wrench of claim 1 wherein said reaction assembly means includes:

reaction rod means adjustably attached to said piston rod means whereby the length of said reaction rod may be adjusted; and an anchoring ring attached to said reaction rod means for removable engagement to a reaction element.

5. The wrench of claim 4 wherein:

said reaction rod means is threadably attached to said piston rod means.

6. The wrench of claim 4 including:

indicia on said reaction rod means for measuring the desired length thereof.

7. The wrench of claim 4 including:

adapter ring means removably insertable into said anchoring ring for adjusting the size thereof in accordance with the size of the reaction element.

8. The wrench of claim 7 including:

at least one groove in said anchoring ring; and retaining springs disposed in said grooves for retaining said adapter ring means within said anchoring ring.

9. The wrench of claim 1 wherein said ratchet means comprises:

a driving pawl; and spring actuated pawl return means positioned in said lever means, said pawl return contacting said driving pawl.

10. The wrench of claim 9 including:

pocket means in said lever arm means, said pocket means having a pair of side openings and an end opening which communicates with said opening in said engagement means, said driving pawl being pivotally mounted in said pocket means;

a pair of retainer plates pivotally attached to said lever arm means and disposed over side openings of said pocket means, said driving pawl being keyed to said retainer plates;

at least one ratchet release lever attached to one of said retainer plates, said ratchet release lever also being attached to said driving pawl wherein said driving pawl, retainer plates and at least one ratchet release lever will rotate in a clockwise or counterclockwise direction with respect to said pocket means.

11. The wrench of claim 10 including:

a pair of oppositely disposed recesses in said lever arm surrounding said pocket means, said retainer plates being disposed in said recesses, said recesses having diameters which are larger than the diameters of said retainer plates whereby said driving pawl bears against said pocket means during a power stroke.

12. The wrench of claim 10 including:

a pair of ratchet release levers, one each being associated with each retainer plate.

13. The wrench of claim 10 wherein:

said retainer plates are circular.

14. The wrench of claim 20 wherein said ratchet assembly means includes:

means for urging said driving pawl inwardly of said lever means opening.

15. The wrench of of claim 14 wherein said means for urging said driving pawl inwardly of said lever arm means opening includes:

a bore in said lever arm means communicating with said pocket means; and pawl return means positioned in said bore for urging said driving pawl inwardly.

16. The wrench of claim 1 wherein:

said lever arm means is comprised of hardened steel.

17. The wrench of claim 16 wherein:

said hardened steel has a hardness of between about 32 to about 36 Rockwell.

18. The wrench of claim 1 including:

star insert means removably insertable into said ratchet assembly means opening, said star insert means comprising a substantially flat annular disc having an interior opening corresponding to the size of the member to be turned and an exterior peripheral edge having a plurality of flat surfaces wherein each adjacent pair of flat surfaces termiantes at an edge with the direction of the edges alternating between the interior and the exterior of said disc.

19. The wrench of claim 18 including:

removable retaining rings for retaining said star insert means in said ratchet assembly means opening.

20. The wrench of claim 1 wherein:

said lever arm means includes yoke means pivotably connected to said cylinder means.

21. The wrench of claim 1 wherein:

said reaction assembly means is in direct alignment with said piston rod.

22. The wrench of claim 21 wherein:

said reaction assembly means is adjustably connected to said piston rod.

23. The wrench of claim 21 wherein said reaction assembly means includes:

reaction rod means extending along the axis of said piston rod; and anchoring ring means attached to said reaction rod means and having a center on the axis of said reaction rod means.

24. The wrench of claim 1 including:

means for changing the preselected angle between said lever arm means and said cylinder means.

25. A fluid powered wrench for torquing a member comprising:

cylinder means having a least a pair of fluid input/output lines and including an internal cavity;

piston means slidably received in said internal cavity of said cylinder means, said piston means having a piston rod and a piston on said piston rod, said piston contacting said internal cavity with at least one of said fluid input/output lines communicating with each chamber wherein said cylinder means is adapted for linear movement between a power stroke and a return stroke as fluid enters and exits each chamber from said input/output lines, said piston rod extending outwardly of said cylinder means at one end of said cylinder;

reaction assembly means attached to a portion of said extending piston rod, said reaction assembly means including means for removable engagement with a reaction element;

lever arm means pivotably attached to said cylinder means;

ratchet assembly means in said lever arm means, said ratchet assembly means including engagement means having an opening therethrough for removable engagement with a member to be turned, ratchet means communicating with said opening for actuating the member to be turned a driving pawl, and spring actuated pawl return means positioned in said lever means, said pawl return contacting said driving pawl;

pocket means in said lever arm means, said pocket means having a pair of side openings and an end opening which communicates with said opening in said engagement means, said driving pawl being pivotally mounted in said pocket means;

a pair of retainer plates pivotally attached to said lever arm means and disposed over said side openings of said pocket means, said driving pawl being keyed to said retainer plates;

at least one ratchet release lever attached to one of said retainer plates, said ratchet release lever also being attached to said driving pawl wherein said driving pawl, retainer plates and at least one ratchet release lever will rotate in a clockwise or counterclockwise direction with respect to said pocket means;

a bore in said lever arm means communicating with said pocket means;

pawl return means positioned in said bore for urging said driving pawl inwardly toward said engagement means of said ratchet assembly means, said pawl return means including:

a plunger, a spring communicating with said plunger, and set screw means retaining said spring in communication with said plunger; and means for establishing a preselected angle between said lever arm means and said cylinder means at the beginning of each power stroke.

26. A fluid powered wrench for torquing a member comprising:

cylinder means having a least a pair of fluid input-/output lines and including an internal cavity;

piston means slidably received in said internal cavity of said cylinder means, said piston means having a piston rod and a piston on said piston rod, said piston contacting said internal cavity whereby said internal cavity is divided into a pair of chambers with at least one of said fluid input/output lines communicating with each chamber wherein said cylinder mean is adapted for linear movement between a power stroke and a return stroke as fluid enters and exits each chamber from said input/output lines, said piston rod extending outwardly of said cylinder means at one end of said cylinder;

reaction assembly means attached to a portion of said extending piston rod, said reaction assembly means including means for removable engagement with a reaction element;

lever arm means pivotably attached to said cylinder means;

ratchet assembly means in said lever arm means, said ratchet assembly means including engagement means having an opening therethrough for removable engagement with a member to be turned, and ratchet means communicating with said opening for actuating the member to be turned;

said lever arm means including yoke means pivotably connected to said cylinder means;

a pair of oppositely disposed pivot caps attached to said yoke means and in contact with said cylinder means whereby said pivot cap/cylinder means defines a bearing; and means for establishing a preselected angle between said lever arm means and said cylinder means at the beginning of each power stroke.

27. A fluid powered wrench for torquing a member comprising:

cylinder means having a least a pair of fluid input-/output lines and including an internal cavity;

piston means slidably received in said internal cavity of said cylinder means, said piston means having a piston rod and a piston on said piston rod, said piston contacting said internal cavity whereby said internal cavity is divided into a pair of chambers with at least one of said fluid input/output lines communciating with each chamber wherein said cylinder means is adapted for linear movement between a power stroke and a return stroke as fluid enters and exits each chamber from said input/output lines, said piston rod extending outwardly of said cylinder means at one end of said cylinder;

reaction assembly means attached to a portion of said extending piston rod, said reaction assembly means including means for removable engagement with a reaction element;

lever arm means pivotably attached to said cylinder means;

ratchet assembly means in said lever arm means, said ratchet assembly means including engagement means having an opening therethrough for removable engagement with a member to be turned, and ratchet means communicating with said opening for actuating the member to be turned;

said lever arm means including yoke means pivotably connected to said cylinder means;

first flat surfaces on said yoke means;

second flat surfaces on said cylinder means, said first flat surfaces engaging said second flat surfaces wherein rotation of said lever arm means is restricted to a plane parallel to the longitudinal axis of said cylinder means; and means for establishing a preselectled angle between said lever arm means and said cylinder means at the beginning of each power stroke.

28. A fluid powered wrench for torquing a member comprising:

cylinder means having at least a pair of fluid input-/output lines and including an internal cavity;

piston means slidably received in said internal cavity of said cylinder means, said piston means having a piston rod and a piston on said piston rod, said piston contacting said internal cavity whereby said internal cavity is divided into a pair of chambers with at least one of said fluid input/output lines communicating with each chamber wherein said cylinder mean is adapted for linear movement between a power stroke and a return stroke as fluid enters and exits each chamber from said input/output lines, said piston rod extending outwardly of said cylinder means at one end of said cylinder;

reaction assembly means attached to a portion of said extending piston rod, said reaction assembly means including means for removable engagement with a reaction element;

lever arm means pivotably attached to said cylinder means;

ratchet assembly means in said lever arm means, said ratchet assembly means including engagement means having an opening therethrough for removable engagement with a member to be turned, and ratchet means communicating with said opening for actuating the member to turned; and means for establishing a preselected angle between said lever arm means and said cylinder means at the beginning of each power stroke, said means for establishing said preselected angle comprising adjustment means mounted in said lever means and contacting said cylinder means, and means for exerting a load on said cylinder means and urging said cylinder means against said adjustment means.

29. A fluid powered wrench for torquing a member comprising:

cylinder means having a least a pair of fluid input-/output lines and including an internal cavity;

piston means slidably received in said internal cavity of said cylinder means, said piston means having a piston rod and a piston on said piston rod, said piston contacting said internal cavity whereby said internal cavity is divided into a pair of chambers with at least one of said fluid input/output lines communicating with each chamber wherein said cylinder mean is adapted for linear movement between a power stroke and a return stroke as fluid enters and exits each chamber from said input/output lines, said piston rod extending outwardly of said cylinder means at one end of said cylinder;

reaction assembly means attached to a portion of said extending piston rod, said reaction assembly means including means for removable engagement with a reaction element;

lever arm means pivotably attached to said cylinder means;

ratchet assembly means in said lever arm means, said ratchet assembly means including engagement means having an opening therethrough for removable engagement with a member to be turned, and ratchet means communicating with said opening for actuating the member to be turned;

means for establishing a preselected angle between said lever arm means and said cylinder means at the beginning of each power stroke; and alignment indicia on said lever means and said cylinder means for determining the pre-selected angle between said lever means and said cylinder means.

* * * * *